US005969469A

United States Patent [19]

Wang

[11] Patent Number: 5,969,469

[45] Date of Patent: Oct. 19, 1999

[54] MINIATURE LAMP ASSEMBLY UTILIZING LAMPBASE HAVING LOWER PROJECTION

[75] Inventor: Jessica Wang, Taipei, Taiwan

[73] Assignee: Toyo Electric Mfg. Co. Ltd., Taipai, Taiwan

[21] Appl. No.: 08/985,602

[22] Filed: Dec. 5, 1997

[51] Int. Cl.[6] ..... H01J 5/48

[52] U.S. Cl. ..... 313/318.1; 313/318.01; 313/318.12

[58] Field of Search ..... 313/318.01, 318.05, 313/318.07, 318.09, 318.1, 318.12

[56] References Cited

U.S. PATENT DOCUMENTS 4,803,396 2/1989 Kelner .
5,001,615 3/1991 Stefanelli .
5,331,529 7/1994 Huang .
5,367,443 11/1994 Hara .
5,498,922 3/1996 Chang .
5,580,159 12/1996 Liu .
5,626,415 5/1997 Huang .

*Primary Examiner*—Vip Patel
*Attorney, Agent, or Firm*—Martin Smolowitz

[57] ABSTRACT

A miniature decorative electric lamp assembly includes an electric bulb having dual bare wires inserted into a lampbase, with the lampbase lower end being received in the upper end of a lampholder socket which contains dual contact or blades each connected to an insulated wire. The lampbase lower end has a lower projection portion which is preferably triangular-shaped and extends downwardly to a position between the dual contact or blades of the lampholder socket, so as to preclude any inadvertent electrical short between the blades and bare upper ends of the insulated wires. This configuration also permits any moisture which may enter the lamp assembly to be reliably drained away through openings in the lampbase lower end and the socket member lower end adjacent the electrical insulated wires.

6 Claims, 2 Drawing Sheets

MINIATURE LAMP ASSEMBLY UTILIZING LAMPBASE HAVING LOWER PROJECTION

BACKGROUND OF INVENTION

This invention pertains to miniature electric lamp assemblies utilizing an improved lampbase member shaped for improved electrical safety. It pertains particularly to such a lamp assembly for which the lampbase member has a lower projection portion which extends downward to between dual electrical contacts in the socket member of the lamp assembly.

Miniature electric lamp assemblies having various configurations have been produced and used for many years. Examples of such known decorative miniature lamp assemblies include U.S. Pat. No. 4,803,396 to Kelner which discloses a light bulb assembly having a bulb inserted into a conventional lampbase but without having any lower projection arranged to extend downwardly in a socket member to between dual electrical connectors to preclude electrical shorts. U.S. Pat. No. 5,001,615 to Stefanelli discloses a lamp assembly having an external positive interlock structure, but the lamp base does not have a lower extension portion extending downwardly between the electrical connectors. U.S. Pat. No. 5,498,922 to Chang and U.S. Pat. No. 5,580,159 to Liu disclose similar conventional lamp assemblies but without a lower projection portion for providing electrical short protection in the lampholder. Also, U.S. Pat. No. 5,626,415 to Huang discloses a decorative moisture-proof lamp assembly including an electrical bulb enclosed within a transparent casing and inserted into a bulb holder which is inserted into a casing socket to provide for a moisture proof configuration, but it does not provide the advantageous feature of a lower extension portion for the lampbase member. Because of these deficiencies in known miniature electric lamp assemblies, further improvements for providing safer and more reliable miniature lamp assemblies are needed.

SUMMARY OF INVENTION

This invention provides a miniature electrical lamp assembly including a bulb having dual bare wires extending from its lower end, the bulb being inserted into an upper cavity of a lampbase member. The lampbase is received in an upper end cup of a socket member having dual electrical insulated wires extending from its lower end, so that the bulb dual bare wires each contact one dual electrical connectors attached to the insulated wires. The lampbase member lower end is sized to be inserted snugly into the upper cup in the socket member to a space between the dual electrical connected wires. The lampbase has a lower projection portion which is preferably triangular-shaped and sized so as to extend between the dual electrical connectors and preclude any electrical shorts occurring in the lamp assembly. The lampbase lower end includes dual-spaced apart openings through which the bulb bare wires are passed, and is specifically sized and shaped for outdoor push-in lampholder use.

The lower triangular-shaped projection extending between the dual bare electrical lead wires entering the lampbase member and the electrical connectors is adapted to preclude short circuits between the wires. The lampbase member dual openings also allows drainage and prevents any water from accumulating within the area of the two wires, thus eliminating any short circuits for a light set using multiple lamp assemblies from occurring. With this lampbase lower end configuration, any moisture entering the lamp assembly upper end passes around the bulb and through the lampbase dual lower openings and does not accumulate in the socket member and cause electrical shorts. This problem occurs in lamp assemblies utilizing a conventional lampbase but without this lower preferably triangular-shaped projection, so that water which can accumulate within the bare lead wire exit area and cause a potential short-circuit situation in the lamp assembly. Also, for the present invention the lamp socket member lower end is open and advantageously permits any moisture which may enter within the socket to be reliably drained away and not accumulate in the lamp assembly, where it might cause an undesired short circuit between the electrical wires in a string of multiple miniature lamp assemblies.

DESCRIPTION OF DRAWING

This invention will be described further with reference to the following drawings, in which.

DESCRIPTION OF INVENTION

Figure 6:
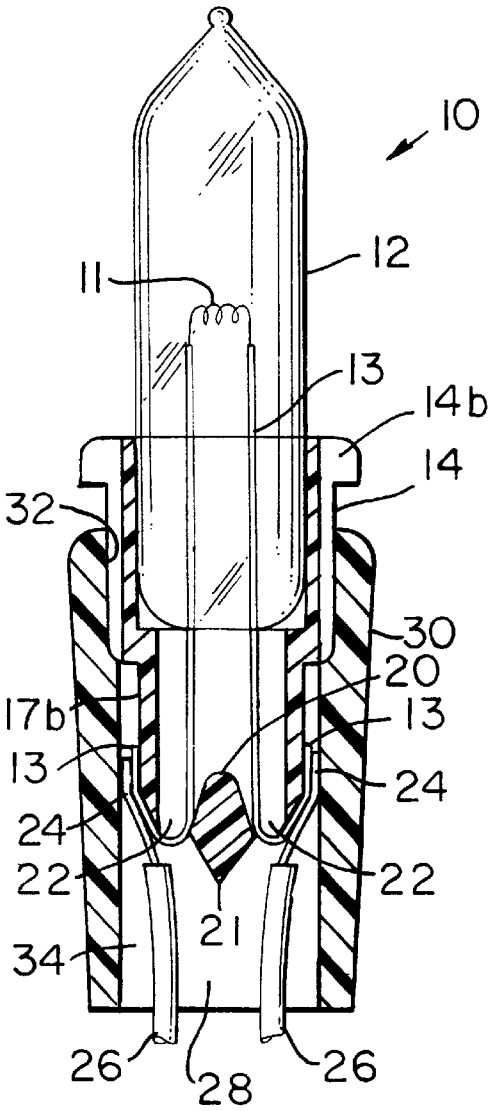
FIG. 6 shows a cross-sectional assembly view of FIG. 1 according to the present invention.
Figure 1:
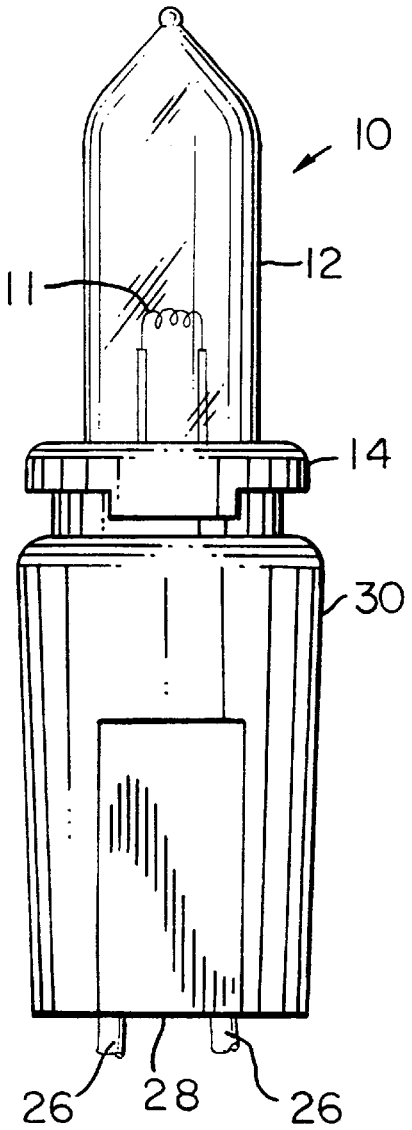
FIG. 1 shows an elevational view of a miniature electrical lamp assembly, including an electric bulb inserted into a lampbase and received in a socket member.
Figure 2:
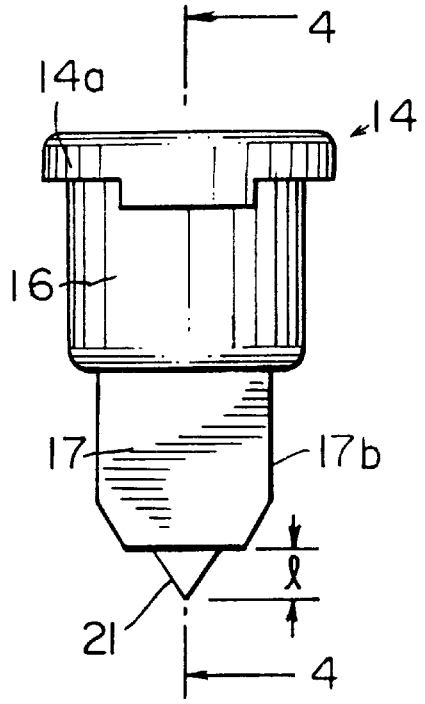
FIG. 2 shows an elevations view of the lampbase member having a triangular-shaped lower end projection portion.
Figure 3:
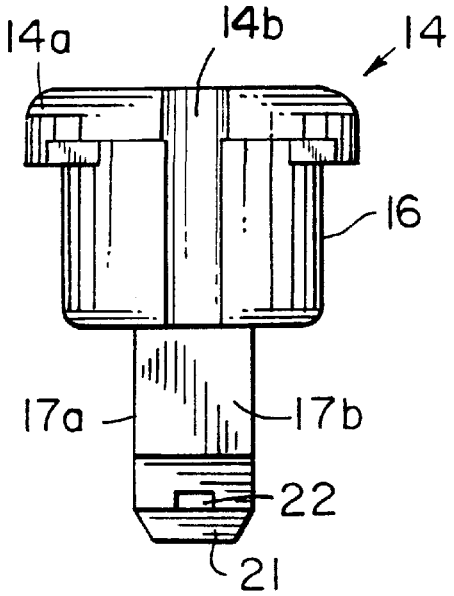
FIG. 3 shows a side view of the FIG. 2 drawing.
Figure 4:
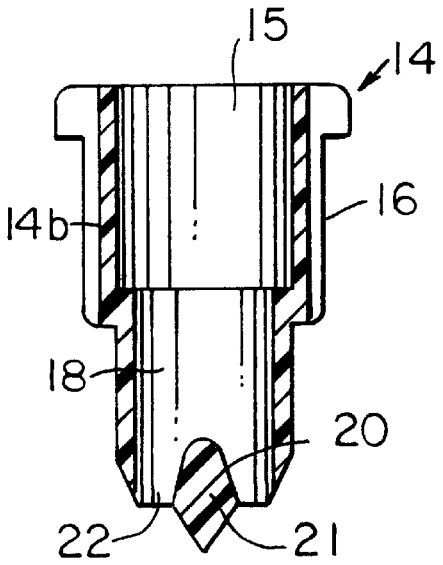
FIG. 4 shows a cross-sectional view taken at line 4—4 of FIG. 2.
Figure 5:
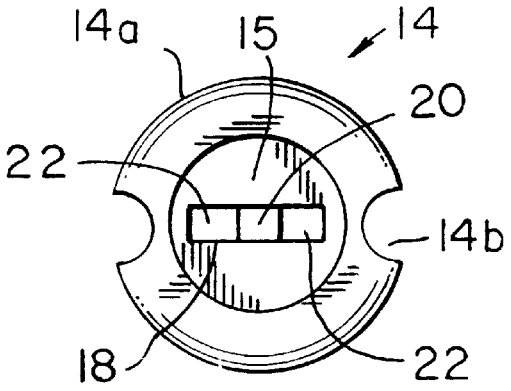
FIG. 5 shows a plan view of the lampbase member.

As shown by FIGS. 1–6, a miniature electrical lamp assembly 10 includes a bulb 12 having an inner filament 11 and dual bare electrical lead wires 13, with the bulb and wires being inserted snugly into a lampbase member 14. The lampbase 14 has an outer flange 14*a* and a central opening or cavity 15 provided in the lampbase upper end. The lampbase 14 is received into the upper end of a holder socket 30 having dual insulated wires 26 extending from its lower end, and has a central lower opening 28.

As further shown by FIGS. 2–5, the lampbase member 14 has a cylindrical-shaped upper portion 16 surrounding a central upper cavity 15, and a central lower extension portion 17 having two flat opposite wide sides 17*a* and narrow sides 17*b*. The lampbase 14 has a central lower inner passage 18 within the extension 17. The lower passage 18 is rectangular-shaped and has a central divider portion 20, which preferably has a lower generally triangular-shaped projection portion 21 extending downwardly from the lower end of the lampbase divider portion 20 and provides dual openings 22 adjacent the dual narrow sides 17*b* for receiving the bare wires 13 which pass through the lampbase. The central lower triangular-shaped projection 21 extends below the lampbase 14 by a length "1" equal to 20–40% of the length of the lampbase flat sided lower extension portion 17. The lampbase upper flange 14*a* and cylindrical portion 16 has dual opposite grooves 14*b*, and rectangular-shaped inner channel 18 has the central projection 20 located between the dual openings 22, as is further shown in plan view by FIG. 5.

As best shown by FIG. 6, the lampbase 14 has its upper portion 16 inserted into cylindrical-shaped cups 32 of the holder socket 30, with the dual bare lead wires 13 of the bulb 12 extend downwardly through the dual openings 22 provided in the lower end of the lampbase 14 and the bare wires 13 are separated by central divider 20 and each bent upwardly against the vertical narrow side surface 17*b* of the lampbase. The wires 13 are each in electrical contact with a metal blade contractor or connector 24, which are each connected to the bare end of one of the dual insulated wires 26 and inserted into the lower end of the central lower passage 34 in the lampholder socket member 30.

It is seen that by this improved lamp assembly configuration, the lower projection 21 which is preferably triangular-shaped extends downwardly from the lampbase 14 to a location between the dual metal connects 24 and also between upper ends of the dual insulated wires 26. thus, even if the electrical insulation 27 of wires 26 does not extend upward to adjacent the bare connectors 24, the lower projection 21 of the lampbase 14 serves to avoid any short circuit between the wires. Also, the lower end of the passage 34 of socket member 30 has a central opening 28 provided between the dual insulated wires 26. By this arrangement, it is apparent that any inadvertent electrical short between the connectors 24 and between the wires 26 is prevented. Also, any moisture which might enter the lamp assembly 10 between the bulb 12 and upper cavity 15 of lampbase 14 will be drained away through the dual openings 22 and the central lower openings 28 and will not be undesirably accumulated within the socket member 30 where it might produce an undesired electrical short circuit within the lamp assembly 10.

This invention will be described further by the following Example, which should not be construed as limiting the scope of the invention.

EXAMPLE

A miniature decorative electrical lamp assembly is produced including a cylindrical-shaped electrical bulb having an internal filament and dual bare wires extending downward from the bulb lower end. The bulb and its bare wires are inserted into a central cylindrical-shaped upper cavity of a lampbase so that the two bare wires extend through dual openings provided in the lampbase lower end extension and each wire extends upwardly along the lampbase narrow outer surface. The lampbase lower end is received in a central opening in a socket member having dual insulated wires entering from its lower end, with each wire being attached to a metal conductor plate which is in electrical contact with one of the two bare wires from the bulb. The lampbase lower end has an inner divider and a triangular-shaped extension portion which extends downwardly to a location between the electrical contact plates and the upper bare ends of the dual insulated wires.

Typical important dimensions for the miniature electrical lamp assembly are as follows:

| | |
|---|---|
| Bulb diameter, mm | 5.3 |
| Lampbase overall length, mm | 13 |
| Lampbase upper cavity dia., mm | 5.4 |
| Lampbase upper cavity depth, mm | 6.0 |
| Lampbase cyl portion dia., mm | .7 |
| Lampbase lower portion length, mm | 5.2 |
| Lampbase lower projection length, mm | 1.5 |
| Socket length, mm | 16 |
| Socket upper cup dia., mm | 7.1 |

Although this invention has been described broadly and in terms of a preferred embodiment, it will be understood that modifications and variations can be made all within the scope as defined by the following claims.

I claim:

1. A miniature electric lamp assembly, comprising:

a lampbase member having a cylindrical-shaped upper portion surrounding a central cylindrical-shaped upper cavity, said lampbase member having a lower portion with an inner channel having dual spaced-apart openings provided at its lower end; the openings being separated by an inner divider portion;

an electrical bulb having dual bare lead wires extending from the bulb lower end, the bulb being received in the lampbase member central upper cavity with the lead wires outer ends each being inserted through one of the dual openings in the lampbase lower end; and a socket member having an upper cavity shaped for receiving the lampbase upper portion and a lower passage shaped for receiving said lampbase lower extension portion, said socket member containing dual electrical metal connectors each connected to wire extending from the socket member lower end, said lampbase lower end being inserted into the socket member upper cavity so that the dual bare wires are each arranged in electrical contact with one of the dual electrical connectors;

said lampbase member having a lower projection portion which extends downwardly to between the dual connectors in the socket member so as to preclude any inadvertent short circuit between the electrical wires and also to permit any moisture which may enter the lampbase to be drained away from the lamp assembly, through the dual openings and socket member lower passage.

2. The lamp assembly of claim 1, wherein said lampbase cylindrical-shaped upper portion has dual oppositely spaced longitudinal grooves.

3. The lamp assembly of claim 1, wherein said lampbase lower projection extends from the lampbase lower end by a length equal to 20–40% of the lampbase lower portion length.

4. The lamp assembly of claim 3, wherein said lampbase member lower projection portion is triangular-shaped.

5. The lamp assembly of claim 4, wherein the lower triangular-shaped projection has a length of 1–3 mm.

6. A miniature electric lamp assembly, comprising:

a lampbase member having a cylindrical-shaped upper portion surrounding a central cylindrical-shaped upper cavity, said lampbase member having an elongated lower portion with flat sides and an inner channel having dual spaced apart openings provided at its lower end; the dual openings being separated by an inner divider element;

an electrical bulb having dual bare lead wires extending from the bulb lower end, the bulb being received in the lampbase member central upper cavity and with the lead wires outer ends each being inserted through one of the dual openings in the lampbase lower end; and a socket member having an upper cavity shaped for receiving the lampbase upper portion and a lower passage shaped for receiving said lampbase lower extension portion, said socket member containing dual electrical metal contact blades each connected to an insulated wire extending from the socket member lower end, said lampbase lower end being inserted into the socket member upper cavity so that the dual bare wires are each arranged in electrical contact with one of the dual electrical contact blades;

said lampbase having a lower triangular-shaped projection portion which extends downwardly to between the dual contact blades in the socket member by a distance equal to 15–25% of the lampbase lower portion length, so as to preclude any inadvertent short circuit between the electrical wires and also to permit any moisture which may enter the lampbase to be drained away from the lamp assembly through the dual openings and socket member lower passage.

* * * * *